US008967057B2

(12) United States Patent
Quiring et al.

(10) Patent No.: US 8,967,057 B2
(45) Date of Patent: Mar. 3, 2015

(54) VERTICALLY ADJUSTABLE PLATFORM SYSTEM

(71) Applicant: South Essex Fabricating Inc., Leamington (CA)

(72) Inventors: Peter Quiring, Leamington (CA); David Knelsen Dyck, Leamington (CA)

(73) Assignee: South Essex Fabricating Inc., Leamington (CA)

( * ) Notice: Subject to any disclaimer, the term of this patent is extended or adjusted under 35 U.S.C. 154(b) by 5 days.

(21) Appl. No.: 13/794,191

(22) Filed: Mar. 11, 2013

(65) Prior Publication Data

US 2014/0123881 A1 May 8, 2014

Related U.S. Application Data

(60) Provisional application No. 61/721,876, filed on Nov. 2, 2012.

(51) Int. Cl.
*A47B 9/00* (2006.01)
*B66F 7/06* (2006.01)

(52) U.S. Cl.
CPC ..... *B66F 7/0666* (2013.01)
USPC ..... 108/147; 108/145

(58) Field of Classification Search
CPC ..... A47B 9/00; A47B 9/06; A47B 9/12; A47B 9/04; B60N 2/162; F16M 11/38; B66F 7/0675; B66F 7/0666; B66F 7/068; B66F 7/10; B66F 7/00
USPC ..... 108/147, 144.11, 145, 108; 254/124, 254/122; 248/421, 439
See application file for complete search history.

(56) References Cited

U.S. PATENT DOCUMENTS

| | | | | | |
|---|---|---|---|---|---|
| 2,752,205 | A | * | 6/1956 | Ward et al. | 254/4 C |
| 3,490,764 | A | * | 1/1970 | Müller et al. | 271/176 |
| 3,610,577 | A | | 10/1971 | Foster, Jr. | |
| 3,982,718 | A | * | 9/1976 | Folkenroth et al. | 248/421 |
| 4,073,386 | A | * | 2/1978 | DeNomme | 414/677 |
| 4,511,110 | A | | 4/1985 | Moller | |
| 4,747,353 | A | * | 5/1988 | Watt | 108/147 |
| 5,002,293 | A | * | 3/1991 | Gottselig | 108/145 |
| 5,402,737 | A | * | 4/1995 | Kanazawa | 108/147 |
| 5,476,050 | A | * | 12/1995 | Zimmer et al. | 108/145 |
| 5,607,282 | A | | 3/1997 | Brannen et al. | |
| 5,699,755 | A | | 12/1997 | Wills et al. | |

(Continued)

FOREIGN PATENT DOCUMENTS

| | | |
|---|---|---|
| EP | 0701884 A1 | 3/1996 |
| EP | 1661490 A1 | 5/2006 |

*Primary Examiner* — Jose V Chen
(74) *Attorney, Agent, or Firm* — Gifford, Krass, Sprinkle, Anderson & Citkowski, P.C.; Douglas L. Wathen

(57) ABSTRACT

A vertically adjustable platform system includes a lifting tower with a lifting mechanism. A first scissors mechanism is adjacent one face of the tower and a second scissors mechanism is adjacent the other face of the tower. A first platform is disposed on the upper end of the first scissors mechanism and a second platform is disposed on an upper end of the second scissors mechanism. A lifting mechanism has a first lifting element interconnected with the first scissors mechanism or the first platform for moving the first platform vertically. The lifting mechanism has a second lifting element interconnected with the second scissors mechanism or the second platform for moving the second platform vertically.

20 Claims, 6 Drawing Sheets

(56) References Cited

U.S. PATENT DOCUMENTS

| | | | | |
|---|---|---|---|---|
| 5,722,331 | A * | 3/1998 | Machael | 108/145 |
| 6,550,724 | B2 * | 4/2003 | Gosling | 108/147 |
| 6,705,238 | B1 * | 3/2004 | Heckert | 108/145 |
| 6,752,074 | B2 | 6/2004 | Lauderbaugh | |
| 7,743,716 | B1 * | 6/2010 | Burka | 108/147 |
| 2003/0079288 | A1 | 5/2003 | Cook et al. | |
| 2007/0071585 | A1 | 3/2007 | Henkel | |
| 2008/0047068 | A1 | 2/2008 | Zakrzewski | |
| 2008/0315168 | A1 | 12/2008 | Takeuchi et al. | |
| 2009/0211879 | A1 | 8/2009 | Milner et al. | |
| 2010/0057246 | A1 | 3/2010 | Hansl et al. | |
| 2010/0192477 | A1 | 8/2010 | Wisner et al. | |
| 2011/0139549 | A1 | 6/2011 | Bacon | |

* cited by examiner

VERTICALLY ADJUSTABLE PLATFORM SYSTEM

CROSS-REFERENCE TO RELATED APPLICATION

This application claims priority to U.S. provisional patent application 61/721,876, filed Nov. 2, 2012, the entire content of which is incorporated herein in its entirety.

FIELD OF THE INVENTION

The present invention relates generally to vertically adjustable supports.

BACKGROUND OF THE INVENTION

There are a wide variety of applications where it is useful to vertically adjust the position of articles resting on a platform. There are devices available that attempt to address this need, including jacks and lifts of various types. However, there remains a need for a vertically adjustable platform system with improved features.

SUMMARY OF THE INVENTION

The present invention provides embodiments of a vertically adjustable platform system. A first embodiment includes a lifting tower having a pair of opposed faces. The lifting tower has a lifting mechanism disposed therein. A first scissors mechanism is disposed adjacent one of the faces of the tower and has a lower end for engaging a support surface and an upper end. A first platform has an upper surface and is disposed on the upper end of the first scissors mechanism. A second scissors mechanism is disposed adjacent the other of the faces of the tower and has a lower end for engaging a support surface and an upper end. A second platform has an upper surface and is disposed on the upper end of the second scissors mechanism. The lifting mechanism has a first lifting element interconnected with a first scissors mechanism or the first platform for moving the first platform vertically. The lifting mechanism also includes a second lifting element interconnected with the second scissors mechanism or the second platform for moving the second platform vertically.

In some versions, the lifting tower includes a first vertical guide bar and a second vertical guide bar. In this version, the first lifting element is a first lifting block that is slidably received on the first vertical guide bar and the second lifting element is a second lifting block that is slidably received on the second vertical guide bar. The lifting mechanism may include a first and second upper sprocket interconnected with an upper end of the lifting tower and a first and second lower sprocket. The lifting mechanism may have a first chain extending around the first upper sprocket and the first lower sprocket, and a second chain extending around the second upper sprocket and the second lower sprocket. The first lifting block may be interconnected with a first chain and directly connected to the first platform for moving the first platform vertically. The second lifting block may be interconnected with the second chain and directly connected with the second platform for moving the second platform vertically.

The system may include a first motor driving the first chain and a second motor driving the second chain, wherein the lifting mechanism is operable to vertically move the first and second platforms and to selectively hold the platforms in a vertical position. The motors may be an electric motor with a gear reduction gear box interconnected with one of the lower chain sprockets. The electric motor preferably includes an electric release brake for selectively holding the motor in a position. The motors may be disposed adjacent a bottom end of the tower and generally perpendicular to one of the faces of the tower. The motors may each extend into an area under one of the platforms.

The lifting mechanism may be the only mechanism moving the platforms and holding the platforms in a vertical position. The lifting mechanism may be generally disposed between the opposed faces of the tower.

In some versions, the platforms each have a first edge and an opposed second edge, with the first edge of the first platform being generally horizontally aligned with the first edge of the second platform and the second edge of the first platform being generally horizontally aligned with the second edge of the second platform. The tower may have a pair of side edges extending between the opposed faces and the side edges may be generally horizontally aligned with the side edges of the platforms.

In some versions, a plurality of vertically adjustable platform systems are disposed side-by-side so as to provide a horizontal array of vertically adjustable platforms.

The scissors mechanisms may each include at least one set of scissor linkages, with each set of scissor linkages including a first pair of links and a second pair of links. The links each have opposed ends and a midsection with the midsections of each of the links in the first pair being pivotally interconnected to the midsections of one of the links in the second pair.

In some versions, the platforms are generally rectangular with inner corners adjacent the lifting tower and outer corners spaced therefrom. The platform system may further include guides for stabilizing articles supported on the platforms. These guides include outer guides that are vertical elements adjacent each of the outer corners. These guides may each have an L-shaped or a T-shaped vertical cross-section with the outer corners being disposed adjacent where the arms of the L-shaped or T-shaped cross-sections come together. The guides may further include inner guides adjacent the inner corners of the platforms and upper horizontal guides extending between the inner guides and outer guides for stabilizing an upper article supported by the platform.

A vertically adjustable platform system in accordance with a second embodiment of the present invention includes a lifting tower having a lifting mechanism disposed therein. A scissors mechanism is disposed adjacent the tower and has a lower end for engaging the support surface and an upper end. A platform has an upper surface and is disposed on the upper end of the scissors mechanism. The lifting mechanism has a lifting element interconnected with a platform for moving the platform vertically.

In some versions, the lifting tower further includes a vertical guide bar and the lifting element is a lifting bar that is slidably received on the vertical guide bar. The lifting mechanism includes an upper sprocket interconnected with an upper end of the lifting tower and a lower sprocket. The lifting mechanism has a chain extending around the upper sprocket and the lower sprocket. The lifting block is interconnected with the chain and interconnected with the platform. A motor may drive the chain, with the motor being disposed adjacent a bottom end of the tower and generally perpendicular thereto. The motor may extend into an area under the platform. The lifting mechanism may be the only mechanism moving the platform and holding the platform in a vertical position.

A vertically adjustable platform system in accordance with a third embodiment of the present invention includes a lifting tower having a pair of opposed faces separate by a tower thickness. The tower includes a lifting mechanism disposed therein with the lifting mechanism being generally disposed between the faces. A first scissors mechanism is disposed adjacent one of the side faces of the tower. The scissors mechanism has a lower end for engaging the support surface and an upper end. A first platform has an upper surface and is disposed on the upper end of the first scissors mechanism. A second scissors mechanism is disposed adjacent the other of the faces of the tower and has a lower end for engaging a support surface and an upper end. A second platform has an upper surface and is disposed on the upper end of the second scissors mechanism. The lifting mechanism has a first and a second upper sprocket and a first and second lower sprocket. The lifting mechanism has a first chain extending around the first upper sprocket and the first lower sprocket and a second chain extending around the second upper sprocket and the second lower sprocket. The lifting tower has a first vertical guide bar and a second vertical guide bar. A first lifting block is slidably received on the first vertical guide bar and a second lifting block is slidably received on the second vertical guide bar. The first lifting block is interconnected with the first chain and connected to the first platform for moving the first platform vertically. The second lifting block is interconnected with the second chain and connected to the second platform for moving the second platform vertically. The lifting mechanism has a first motor driving the first chain and a second motor driving the second chain, such that the lifting mechanism is operable to vertically move the first and second platforms and to selectively hold the platforms in a vertical position. The lifting mechanism is the only mechanism moving the platforms and holding the platforms in a vertical position.

DETAILED DESCRIPTION OF THE PREFERRED EMBODIMENTS

The present invention provides a system with vertically adjustable platforms for supporting articles and vertically adjusting the position of those articles. Embodiments of the present invention include a platform that is disposed on an upper end of a scissors mechanism and a lifting tower that is adjacent to the mechanism and platform, and includes a lifting mechanism that vertically adjusts the position of the platform.

Figure 1:
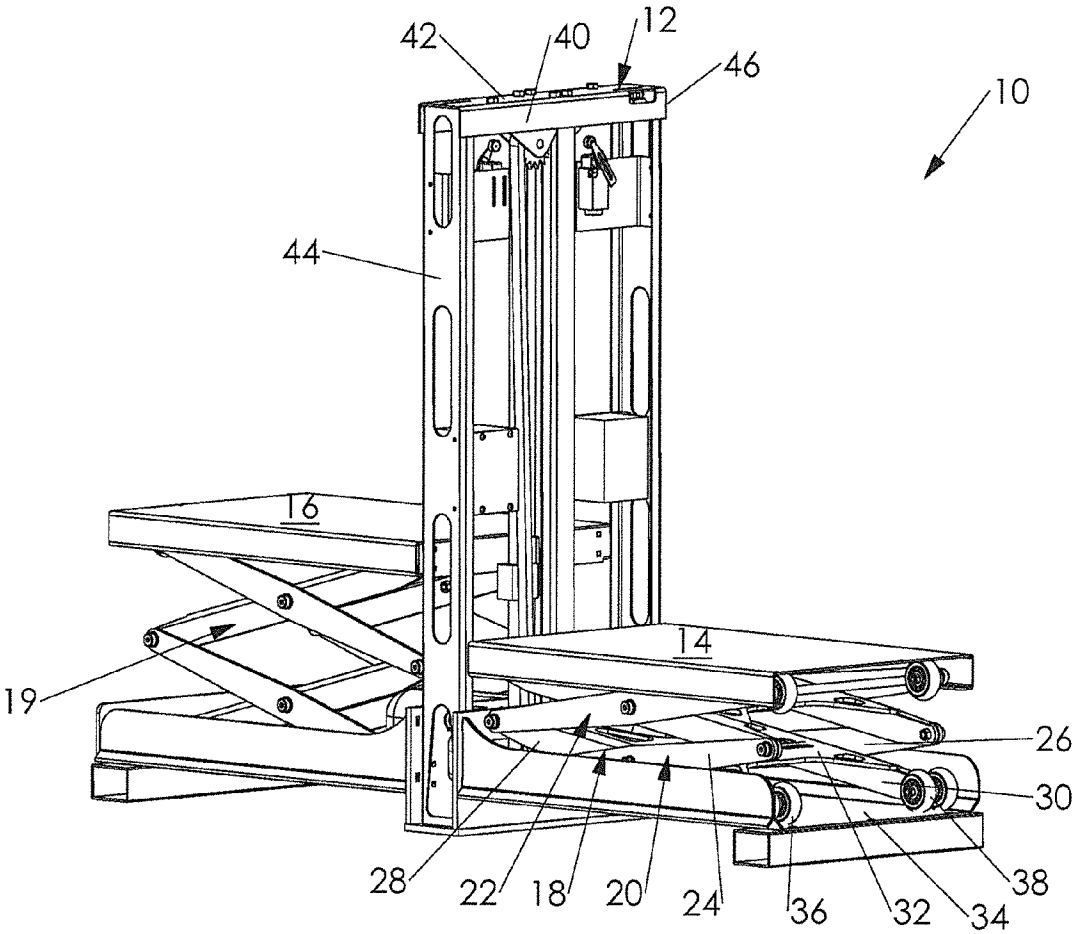
FIG. 1 is a perspective view of an embodiment of a vertically adjustable platform system in accordance with the present invention.

Referring to FIG. 1, a first embodiment of a vertically adjustable platform system in accordance with the present invention is shown generally at 10. The system includes a lifting tower 12, a first platform 14, and a second platform 16. In this embodiment, each platform 14 and 16 has a generally horizontal upper surface and a generally rectangular footprint. The system also includes a first scissors mechanism 18 and a second scissors mechanism 19, with the first platform 14 being disposed on an upper end of the first scissors mechanism 18 and the second platform 16 being disposed on an upper end of the second scissors mechanism 19. The lifting tower 12 has a lifting mechanism for vertically adjusting the position of the platforms 14 and 16.

In this embodiment, the scissors mechanisms each include two sets of scissor linkages. Scissors mechanism 18 has a first set of linkages 20 and a second set of linkages 22 with the second set being interconnected with the upper end of the first set. As will be clear to those of skill in the art, more or fewer sets of scissor linkages may be used depending on the application of the mechanism.

The linkage 20 includes a first link 24 and a second link 26 that are parallel to one another and spaced apart at opposite sides of the mechanism 18. A third link 28 and fourth link 30 are also parallel to one another and spaced apart at opposite sides of the mechanism 18. The first link 24 and the third link 28 are rotatably interconnected with each other at their midportions so as to form an X or a "scissor". Likewise, the second link 26 and the fourth link 30 are rotatably interconnected with each other at their midportions. In this embodiment, the second link 26 and fourth link 30 are interconnected with one another by a cross brace 32. This cross brace 32 forces the second link 26 and fourth link 30 to remain parallel and co-planar and maintains a fixed distance between them. By rotating the third link 28 and fourth link 30 relative to the first link 24 and second link 26, the overall height of the linkage 20 is increased and decreased.

The links 24-30 may be said to have lower ends and upper ends. The lower ends are adjacent a base member 34 that is interconnected with the lower end of the tower 12 and provides a support surface for the scissors mechanism 18. Alternatively, the scissors mechanism may be supported on a floor adjacent to the tower 12. In this embodiment, the lower ends of the links 24 and 26 are pivotally interconnected with the tower 12 and the lower ends of the links 28 and 30 have wheels, 36 and 38 respectively, that roll on the base member 34 as the links rotate with respect to one another. This arrangement maintains the position of the innermost end of the scissors mechanism 18 with respect to the tower 12. The second set of scissor linkages 22 has the lower ends of its links pivotally interconnected with the upper ends of the links 24-30 of the first set of scissor linkages 20. The platform 14 is disposed on the upper ends of the links in the second set of the scissor linkages 22. The ends that are closest to the tower 12 are pivotally interconnected with the platform 14 while the ends that are away from the tower have wheels. As such, the edge of the platform 14 closest to the tower remains at a constant distance from the tower.

The scissors mechanism 19 is the same as the mechanism 18, and will not be described in detail.

Figure 2:
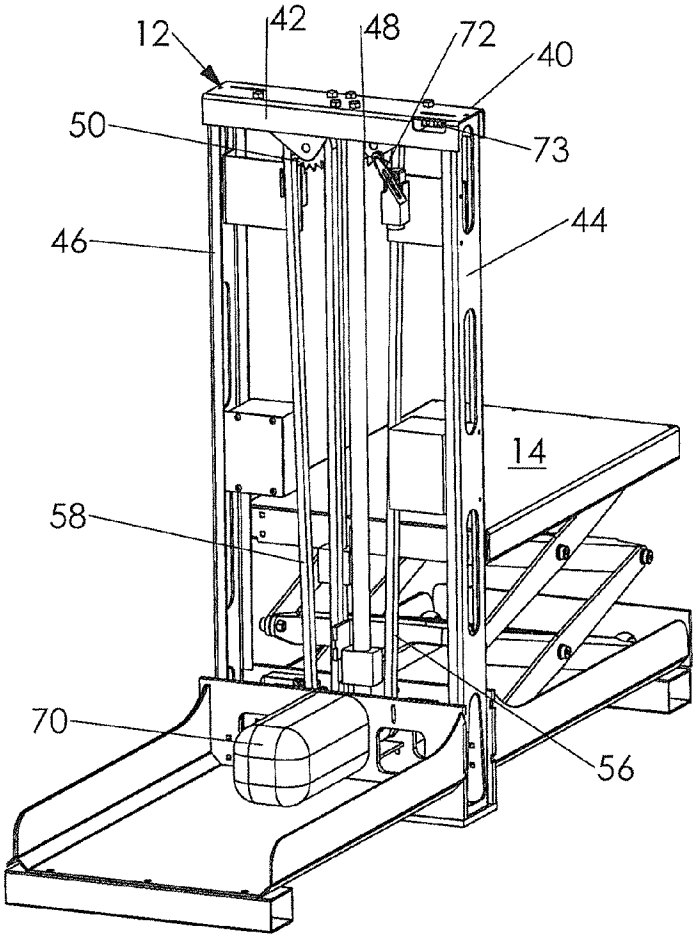
FIG. 2 is another perspective view of the platform system with some components removed.
Figure 3:
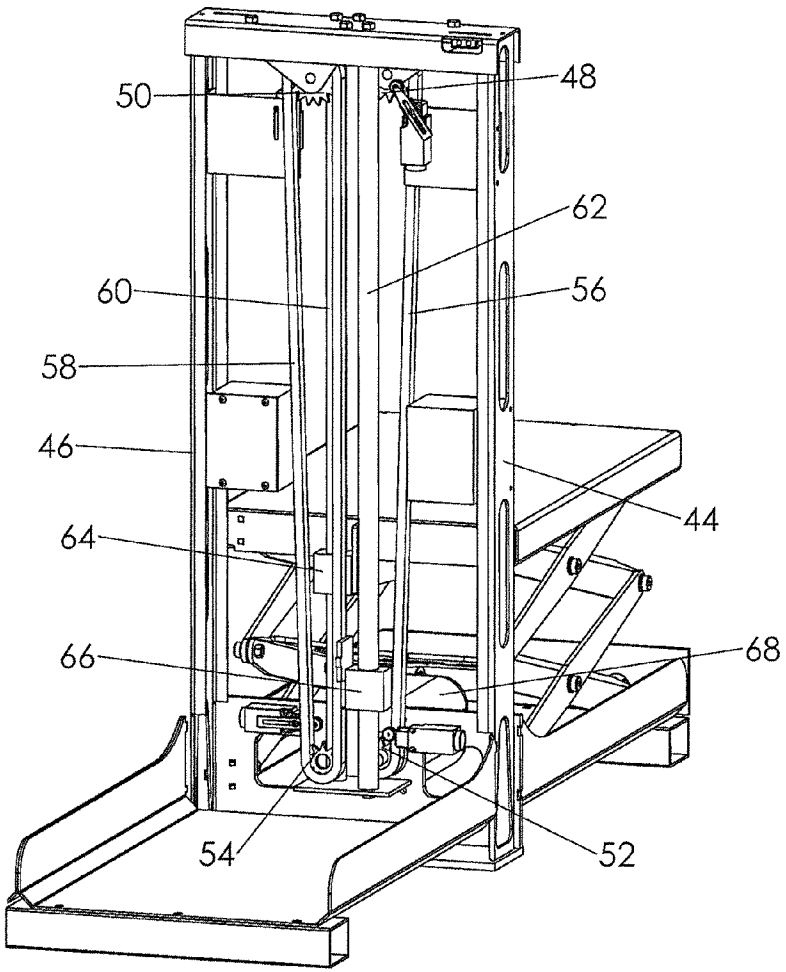
FIG. 3 is a perspective view of the platform system with additional components removed.

Referring now to FIG. 1-3, the lifting tower and lifting mechanism will be described in more detail. As shown, the tower 12 is a generally vertical rectangle. It may be said to have a pair of opposed faces 40 and 42 that are separated by a tower thickness. The first platform 14 and first scissors mechanism 18 are adjacent the first face 40 and the second platform 16 and second scissors mechanism 19 are adjacent the second face 42. The faces 40 and 42 are open to allow connections between the lifting mechanism and the platforms or scissors mechanisms. The faces 40 and 42 may be said to be interconnected by a pair of vertical side surfaces 44 and 46. In this embodiment, the side edges of the platforms 14 and 16 are generally aligned with each other and generally aligned with side surfaces 44 and 46 of the tower 12.

The lifting mechanism may take a variety of forms. In the illustrated embodiment, a first upper chain sprocket 48 and a second upper chain sprocket 50 are rotatably interconnected with the upper end of the tower 12. A first lower chain sprocket 52 and a second lower chain sprocket 54 are located near the bottom of the tower 12 and generally aligned with their respective upper chain sprockets. A first chain 56 extends around the first upper chain sprocket 48 and first lower chain sprocket 52, and a second chain 58 extends around the second upper sprocket 50 and second lower sprocket 54. In each case, the chain may be a continuous loop. Alternatively, a belt, such as a toothed belt, may be used in place of a chain.

As best shown in FIG. 3, the lifting tower further includes a first vertical guide bar 60 and a second vertical guide bar 62. These each extend generally vertically between the upper and lower ends of the tower 12. A first lifting block 64 is slidably received on the first vertical guide bar 60 and a second lifting block 66 is slidably received on the second vertical guide bar 62. The first chain 56 is interconnected with the first lifting block 64 such that movement of the chain causes vertical movement of the lifting block. Likewise, the second chain 58 is interconnected with the second lifting block 66. The lifting blocks 64 and 66 are, in turn, interconnected with the platforms 14 and 16. As such, movement of the chains cause vertical movement of the lifting blocks and thereby causes vertical movement of the platforms. In the illustrated embodiment, the lifting blocks are directly connected to an inner edge of the platforms. They could, alternatively, be interconnected with other portions of the platforms or with the scissors mechanism for vertically moving the platforms. In preferred embodiments of the present invention, the lifting mechanism in the tower is the only mechanism that controls the vertical position of the platforms. No additional actuation is provided and the motors hold the platforms in any position, as needed.

In the illustrated embodiment, a first motor 68 engages and drives the first lower chain sprocket 52 and a second motor 70 engages and drives the second lower chain sprocket 54. The motors are rotary motors and include gear reduction gear boxes. The electric motors preferably include an electric release brake for selectively holding the motor in a position. The motors 68 and 70 extend generally perpendicularly from the faces of the tower such that they are disposed in the area under the platforms 14 and 16. As shown, the crossbars that interconnect the opposing sides of the scissors linkages are shaped so as to clear the motors when the platforms are in their lowest position.

Limit switches may be included for determining when the platforms have reached the uppermost or lowermost extent of their travel. One such limit switch is shown at 72 in FIG. 2.

The design of the lifting tower, lifting mechanism, and scissors mechanisms of the present invention provides several advantages. Typically, scissors mechanisms are moved by drives or actuators that act between links of the scissors mechanism so as to draw them towards one another, thereby lifting an upper end of the scissors mechanism. However, in order to have a power actuated scissors mechanism with an actuator acting between linkages, the actuator must necessarily be disposed in an area that would be below the platform of the present invention. This interferes with moving the platform to its lowermost position. The mechanical advantage of the actuator also changes as the relative position of the links changes. The present mechanism allows a much more compact position for the scissors mechanism in its lowest position. Unlike other scissors mechanisms, the lifting mechanism of the present invention lifts the platform itself, with the scissors mechanism following along and acting to keep the platform level and stable, rather than using the scissors mechanism to lift the platform. The present mechanism also allows very smooth movement of the platform throughout its range of motion, since the mechanical advantage is constant. The arrangement of the motors, chains, and lifting blocks is also very compact, allowing the thickness of the tower between the faces 40 and 42 to be very small. In one example, the tower has an overall height of approximately 42 inches, a thickness between the faces 40 and 42 of approximately 3½ inches, and a side-to-side width between the sides 44 and 46 of approximately 16½ inches. In this example, the platforms have a side-to-side width of approximately 16 inches and an end-to-end length of approximately 25 inches. The platforms, in their lowermost position, are approximately 34 inches below the top of the tower and about 7½ inches above the support surface. In their uppermost position, the platforms may be at or near the top of the tower, giving a range of motion of approximately 34 inches. Other dimensions and configurations may also be used.

The design of the lifting mechanism allows the platforms 14 and 16 to be generally aligned with each other rather than being staggered. Alternatively, the platforms may be staggered, if desired.

Figure 4:
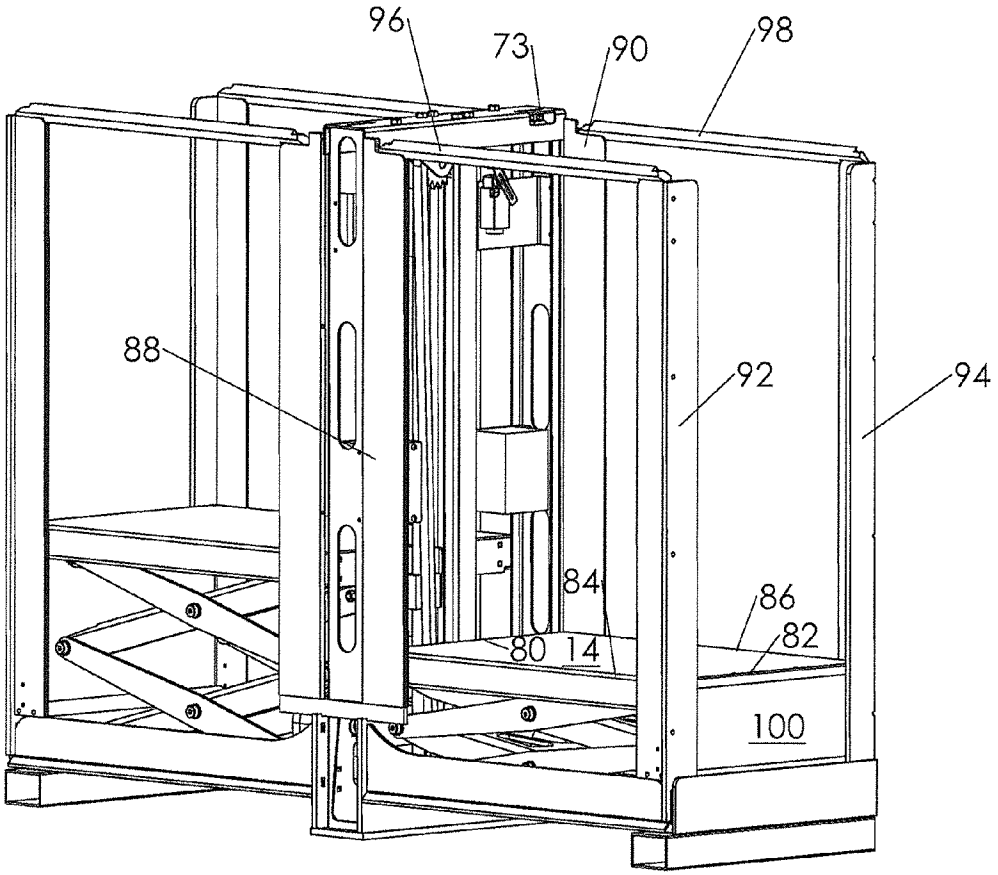
FIG. 4 is a perspective view of the platform system of FIG. 1 with optional additional elements.

Referring now to FIG. 4, the platform system is shown with optional guides and covers. The platform system may be used to support a vertical stack of articles on the upper surface of each platform. In order to stabilize the stack of articles, guides may be provided. In the embodiment illustrated in FIG. 4, the platform 14 may be said to have an inner end 80 and an outer end 82, as well as opposed side edges 84 and 86. Inner side guides 88 and 90 may be provided adjacent the side edges 84 and 86 at the inner end 80. In the illustrated embodiment, these guides 88 and 90 are flat elements that extend vertically along the sides of the platform and extend for its entire range of motion. Additional outer guides 92 and 94 are vertical members with an L-shaped or T-shaped cross-section and are positioned at the corners where the outer end 82 meets the side edges 84 and 86. The corners of the platform 14 are adjacent the area where the legs of the L-shaped or T-shaped guides 94 come together. Top guides 96 and 98 may also be provided. In this embodiment, the guides 96 and 98 extend between the upper ends of the guides 88 and 92, and 90 and 94, respectively. These guides may have inner surfaces that are slightly closer together than the inner surfaces of the guides 88 through 94 so as to snugly hold an article at the uppermost end of a stack on the platform 14. The illustrated embodiment also includes a cover 100 that extends down from the outer edge 82 of the platform so as to cover the area below the platform where the scissors mechanism is provided. This cover 100 may be cosmetic or may serve the function of limiting airflow between areas on the two sides of the cover. In some versions, the cover 100 is stowed on a roll attached to the outer edge 82 of the platform 14 and unrolls as the platform moves upwardly.

Thus far, the vertically adjustable platform system of the present invention has been described as having a lifting tower and two platforms adjacent thereto. According to an alternative embodiment, a single platform is provided for use with a tower. This embodiment is used for applications requiring only a single platform or where multiple platforms need to be arranged in an arrangement not on two sides of the tower.

Figure 5:
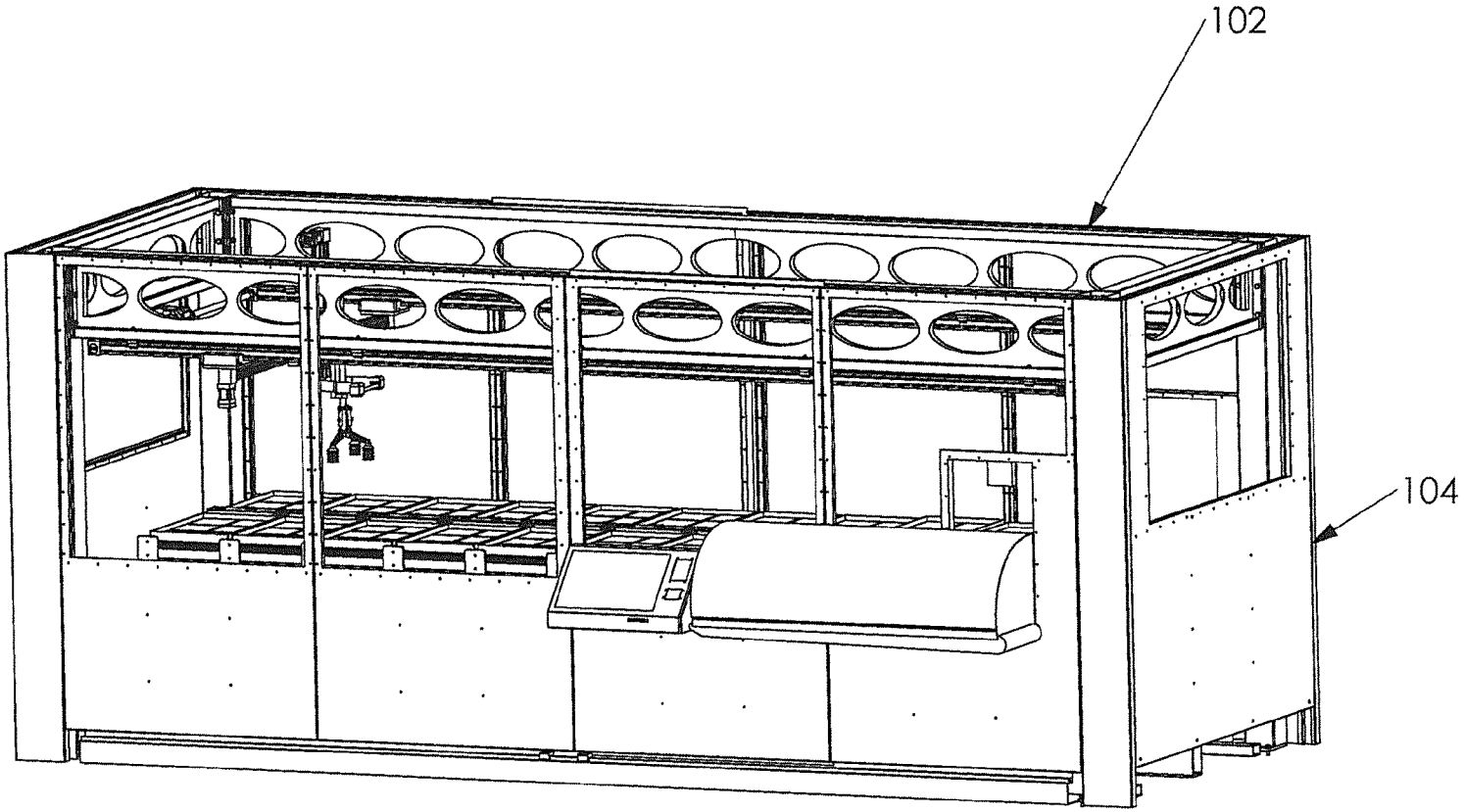
FIG. 5 is a perspective view of a automated produce department that is an application for a platform system in accordance with the present invention.
Figure 6:
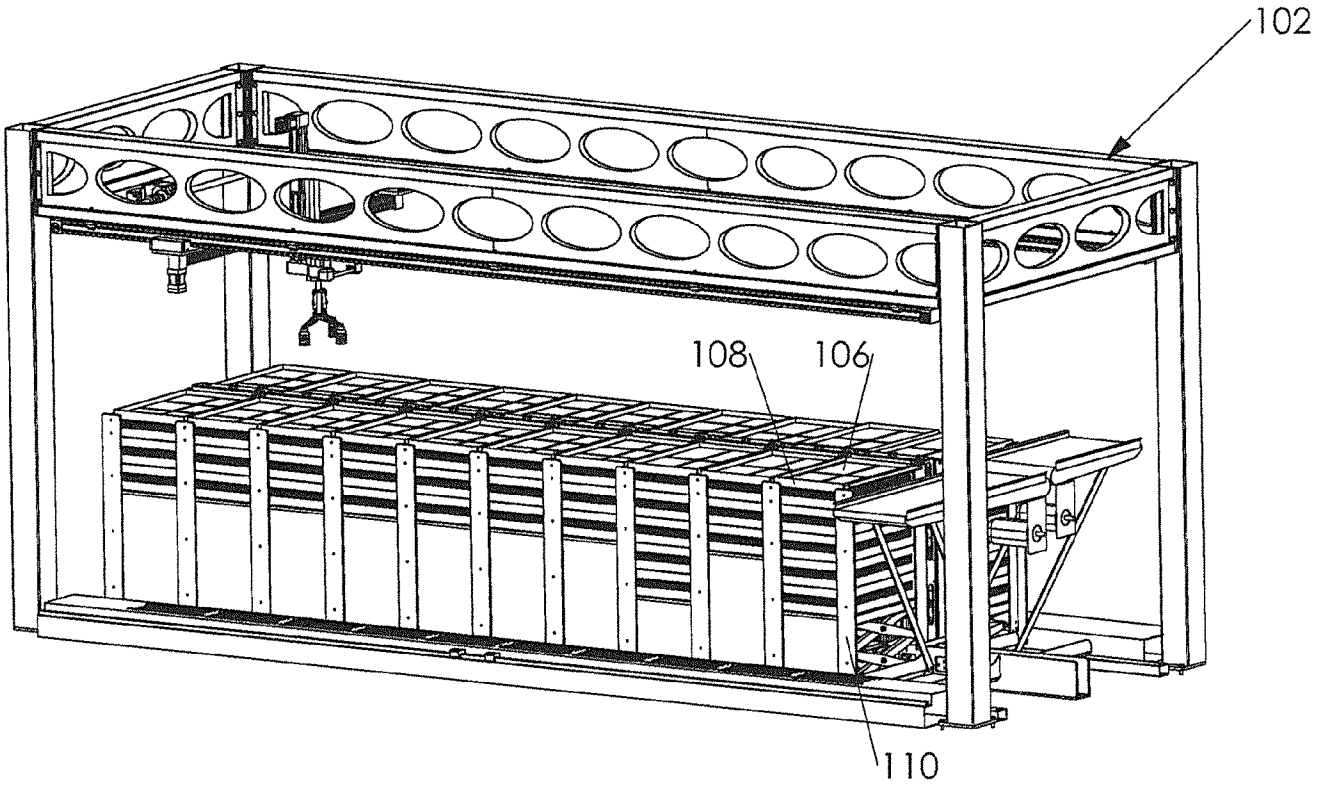
FIG. 6 is a perspective view of the automated produce department of FIG. 5 with portions of the outer housing removed.

As will be clear to those of skill in the art, a vertically adjustable platform system in accordance with the present invention has a wide variety of uses. FIG. 5 illustrates an automated produce department 102, which represents one application for the vertically adjustable platform system. The automated produce department includes a housing 104 that encloses a display area. FIG. 6 illustrates the automated produce department 102 with portions of the housing removed. As shown, the automated produce department utilizes a plurality of vertically adjustable platform systems in accordance with the present invention, arranged side-by-side. Produce is provided in packages 106, with multiple packages provided in a produce tray 108. A plurality of trays are stacked in a vertical stack on a platform of the vertically adjustable platform system 110. As trays of produce are depleted, the tray is removed by the automated produce department and the platform system adjusts the vertical position of the platform so as to maintain a generally horizontal display of produce. It is desirable that a platform system for such an application provide a large range of motion, a very compact lowermost position, and a smooth movement of the platform to a variety of positions. In some embodiments, the platform system includes electronic sensors for sensing the position of items stacked on the platforms. Referring to FIGS. 2 and 4, an electronic sensor is shown at 73. This sensor may be a photoelectric sensor that senses when the upper edge of a produce tray reaches the level of the sensor. This may form part of a control system wherein when a tray is removed, the platform system moves the platform upwardly until the electronic sensor 73 determines that the next tray has reached the desired level. When the last tray is removed, the platform may move upwardly until the limit switch 72 determines that it has reached the top of its travel. Sensors may be provided on each side of the tower for use with both platforms. Other types of sensors may also be used.

As will be clear to those of skill in the art, the herein discussed embodiments of the present invention may be altered in various ways without departing from the scope or teaching of the present invention. It is the following claims, including all equivalents, which define the scope of the invention.

We claim:

1. A vertically adjustable platform system, comprising:

a lifting tower having a pair of opposed faces, the lifting tower having a lifting mechanism disposed therein;

a first scissors mechanism disposed adjacent one of the faces of the tower, the scissors mechanism having a lower end for engaging a support surface and an upper end;

a first platform having an upper surface, the first platform being disposed on the upper end of the first scissors mechanism;

a second scissors mechanism disposed adjacent the other of the faces of the tower, the scissors mechanism having a lower end for engaging a support surface and an upper end;

a second platform having an upper surface, the second platform being disposed on the upper end of the second scissors mechanism; and the lifting mechanism having a first lifting element interconnected with the first scissors mechanism or the first platform for moving the first platform vertically, the lifting mechanism further having a second lifting element interconnected with the second scissors mechanism or the second platform for moving the second platform vertically.

2. A vertically adjustable platform system in accordance with claim 1, wherein:

the lifting tower further includes a first vertical guide bar and a second vertical guide bar;

the first lifting element being a first lifting block that is slidably received on the first vertical guide bar; and the second lifting element being a second lifting block that is slidably received on the second vertical guide bar.

3. A vertically adjustable platform system in accordance with claim 2, wherein:

the lifting mechanism includes a first and a second upper sprocket interconnected with an upper end of the lifting tower and a first and a second lower sprocket;

the lifting mechanism having a first chain extending around the first upper sprocket and the first lower sprocket and a second chain extending around the second upper sprocket and the second lower sprocket;

the first lifting block being interconnected with the first chain and directly connected with the first platform for moving the first platform vertically; and the second lifting block being interconnected with the second chain and directly connected with the second platform for moving the second platform vertically.

4. A vertically adjustable platform system in accordance with claim 3, further comprising:

a first motor driving the first chain; and a second motor driving the second chain;

wherein the lifting mechanism is operable to vertically move the first and second platforms and to selectively hold the platforms in a vertical position.

5. A vertically adjustable platform system in accordance with claim 4, wherein:

the motors each comprise an electric motor with a gear reduction gearbox interconnected with one of the lower chain sprockets.

6. A vertically adjustable platform system in accordance with claim 4, wherein:

the motors are each disposed adjacent a bottom end of the tower and generally perpendicular to one of the faces of the tower, the motors each extending into an area under one of the platforms.

7. A vertically adjustable platform system in accordance with claim 1, wherein:

a single mechanism is provided for moving the platforms and holding the platforms in a vertical position, said single mechanism being the lifting mechanism.

8. A vertically adjustable platform system in accordance with claim 1, wherein:

the lifting mechanism is generally disposed between the opposed faces of the tower.

9. A vertically adjustable platform system in accordance with claim 1, wherein:

each of the platforms has a first edge and an opposed second edge, the first edge of the first platform being generally horizontally aligned with the first edge of the second platform and the second edge of the first platform being generally horizontally aligned with the second edge of the second platform.

10. A vertically adjustable platform system in accordance with claim 9, wherein:

the tower has a pair of side edges extending between the opposed faces, the side edges being generally horizontally aligned with the side edges of the platforms.

11. A vertically adjustable platform system in accordance with claim 1, further comprising:

a plurality of vertically adjustable platform systems disposed side by side so as to provide a horizontal array of vertically adjustable platforms.

12. A vertically adjustable platform system in accordance with claim 1, wherein:

the scissor mechanisms each comprising at least one set of scissor linkages, each set of scissor linkages comprising a first pair of links and a second pair of links each having opposed ends and a mid section, the mid sections of each of the links in the first pair being pivotally interconnected to the mid sections of one of the links in the second pair.

13. A vertically adjustable platform system in accordance with claim 1, wherein:

the platforms are generally rectangular with inner corners adjacent the lifting tower and outer corners spaced therefrom; and the platform system further comprising guides for stabilizing articles supported on the platforms, the guides including outer guides that are vertical elements adjacent each of the outer corners.

14. A vertically adjustable platform system in accordance with claim 13, wherein:

the guides each have an L-shaped vertical cross section, with the outer corners being disposed adjacent where the arms of the L-shaped cross sections come together.

15. A vertically adjustable platform system in accordance with claim 1, wherein:

the guides further include inner guides adjacent the inner corners of the platforms and upper horizontal guides extending between the inner guides and the outer guides for stabilizing an upper article supported by the platform.

16. A vertically adjustable platform system, comprising:

a lifting tower having a lifting mechanism disposed therein;

a scissors mechanism disposed adjacent the tower, the scissors mechanism having a lower end for engaging a support surface and an upper end, the scissor mechanism further comprising at least one set of scissor linkages, each set of scissor linkages comprising a first pair of links and a second pair of links each having opposed ends and a mid section, the mid sections of each of the links in the first pair being pivotally interconnected to the mid sections of one of the links in the second pair;

a platform having an upper surface with peripheral edges, the platform being disposed on the upper end of the scissors mechanism and adjacent the lifting tower; and the lifting mechanism having a lifting element engaging one of the peripheral edges for moving the platform vertically the lifting mechanism not disposed under the platform.

17. A vertically adjustable platform system in accordance with claim 16, wherein:

the lifting tower further includes a vertical guide bar, lifting element being a lifting block that is slidably received on the vertical guide bar; and the lifting mechanism includes an upper sprocket interconnected with an upper end of the lifting tower and a lower sprocket;

the lifting mechanism having a chain extending around the upper sprocket and the lower sprocket; and the lifting block being interconnected with the chain and interconnected with the platform.

18. A vertically adjustable platform system in accordance with claim 17, further comprising:

a motor driving the chain, the motor being disposed adjacent a bottom end of the tower and generally perpendicular thereto, the motor extending into an area under the platform.

19. A vertically adjustable platform system in accordance with claim 16, wherein:

a single mechanism is provided for moving the platform and holding the platform in a vertical position, said single mechanism being the lifting mechanism.

20. A vertically adjustable platform system, comprising:

a lifting tower having a pair of opposed faces separated by a tower thickness, the tower includes a lifting mechanism disposed therein, the lifting mechanism being general disposed between the faces;

a first scissors mechanism disposed adjacent one of the faces of the tower, the scissors mechanism having a lower end for engaging a support surface and an upper end;

a first platform having an upper surface, the first platform being disposed on the upper end of the first scissors mechanism;

a second scissors mechanism disposed adjacent the other of the faces of the tower, the scissors mechanism having a lower end for engaging a support surface and an upper end;

a second platform having an upper surface, the second platform being disposed on the upper end of the second scissors mechanism; and the lifting mechanism having a first and a second upper sprocket and a first and a second lower sprocket, the lifting mechanism having a first chain extending around the first upper sprocket and the first lower sprocket and a second chain extending around the second upper sprocket and the second lower sprocket, the lifting tower further having a first vertical guide bar and a second vertical guide bar, a first lifting block being slidably received on the first vertical guide bar and a second lifting block being slidably received on the second vertical guide bar, the first lifting block being interconnected with the first chain and connected to the first platform for moving the first platform vertically, the second lifting block being interconnected with the second chain and connected to the second platform for moving the second platform vertically, the lifting mechanism having a first motor driving the first chain and a second motor driving the second chain such that the lifting mechanism is operable to vertically move the first and second platforms and to selectively hold the platforms in a vertical position; and wherein a single mechanism is provided for moving the platforms and holding the platforms in a vertical position, said single mechanism being the lifting mechanism.

* * * * *